US006128793A

United States Patent [19]

Weinstein

[11] Patent Number: 6,128,793

[45] Date of Patent: Oct. 10, 2000

[54] COMPLETE PRE-FABRICATED TILE COUNTER IN COMPONENTS

[76] Inventor: Albert I. Weinstein, 28710 Atford Dr., Rancho Palos Verdes, Calif. 90275

[21] Appl. No.: 09/334,899

[22] Filed: Jun. 17, 1999

[51] Int. Cl.[7] ..... A47K 1/00

[52] U.S. Cl. ..... 4/631; 4/638; 312/140.3; 312/140.1; 52/36.2

[58] Field of Search ..... 4/631, 632, 633, 4/634, 635, 636, 638; 312/140.1, 140.2, 140.3, 140.4; 52/34, 36.1, 36.2, 344, 347

[56] References Cited

U.S. PATENT DOCUMENTS 2,505,828 5/1950 Fox ..... 4/631
4,771,488 9/1988 Markham ..... 4/631
5,722,746 3/1998 Hull et al. ..... 312/140.3
5,733,022 3/1998 Whetstone ..... 4/631

*Primary Examiner*—David J. Walczak
*Attorney, Agent, or Firm*—Monty Koslover

[57] ABSTRACT

A complete pre-fabricated tile counter is described that is already tiled and grouted and ready for installation upon a cabinet or other substructure, with or without a back splash or side splash panel. Counter tops including built-in sinks, and counters and splash panels may be produced economically in any style, shape and tile selected by a homeowner or builder prior to installation at a site. The invention counters are designed to be installed easily by the average homeowner or builders, in a minimum of time and with little mess to be cleaned up.

17 Claims, 5 Drawing Sheets

COMPLETE PRE-FABRICATED TILE COUNTER IN COMPONENTS

BACKGROUND OF THE INVENTION

1. Field of the Invention

This invention relates to the installation of tiled counters in locations such as bathrooms and kitchens.

2. Background

At present, the installation of tiled counters is a messy, often difficult and time consuming work project, even when performed by experienced professionals. After the tiles have been selected and cost estimated, a skilled tile-setter has to come to the work site (kitchen or bathroom) and do the work. This work involves the use of many materials such as mortar, sheetrock or cement board, thinset and grout, leaving bits and pieces to be cleaned up.

The workmanship and quality of the installed counter is subject to the skill of the tile-setter, which is usually unknown to a homeowner at the time of contracting. If the homeowner finds the work to be shoddy or otherwise unsatisfactory, a dispute can arise that may be difficult to settle amicably. For builders who install counters in newly built houses, the problem is one of quality control as well as the installation time and cost. At present, even the smallest counter would take two days to complete.

Normally, a tile for a counter is first selected by the customer before installation and the customer must attempt to visualize what the completed product will look like. Such judgements are not easily made, sometimes leading to negative results where both customer and installer are disaffected. In this case, the customer usually has no choice but to live with the resulting installation although it may be unsatisfactory.

At present, even the smallest counter would take at least two days to complete by professional installers, causing unwelcome irritation of homeowners. This installation time and cost is even more important in commercial applications.

There have been a number of approaches to easing the problems and difficulties inherent in the time honored methods of installing tiled counters and walls for a bathroom and kitchen. Some involve pre-fabrication of various parts. However, all still require considerable tiling work to be performed by a skilled person at the installation site. An example is a recently issued U.S. Pat. No. 5,816,005 by Han, who describes a pre-fabricated tiled panel.

For installing on a counter or wall, the panels have to be individually placed on a counter base or wall surface and each fastened in place before adding the next panel until all are completed. A number of tiles are left off each panel to allow for fastening the panel to a base or wall. The panel edge trim is also generally omitted from the prefabricated panel.

While the Han approach described above is definitely an improvement on the current industry wide methods, it still requires the services of a skilled tile setter on site to install and properly join the panels. He must also install the missing tiles described above and other tiling such as edge trim; all of which has to be done on site, leaving a mess to be cleaned up. Furthermore, the Han approach does not permit a customer to see what a finished counter will look like before installation and before the customer commits to a tiled configuration.

There remains a universal need by homeowners and building contractors to overcome the ongoing problems of cost, quality control, customer inconvenience and possible dissatisfaction that are inherent in the current methods of installing a tiled counter or other tiled portion.

SUMMARY OF THE INVENTION

The invention is a complete pre-fabricated tile counter top that is already tiled and grouted and ready for installation upon a cabinet or other substructure, with or without a back splash or side splash panel. The counter top and any splash panels would be done in any style, shape and tile desired and selected by a customer and could include sinks. No tiling of any sort need be done on the installation site. The counter top and splash panels can be produced economically and installed quickly without a mess on site, requiring little installation skill.

Accordingly it is a principal object of this invention to provide a complete, pre-fabricated tiled counter plus splash panels capable of being installed easily and quickly by relatively unskilled persons.

Another object is to provide a complete tiled counter that can be viewed by a customer prior to installation.

Yet another object is to provide a complete tiled counter that can produced in any shape, design and tile color that meets a customer's requirement and preference.

A major advantage of this invention over existing methods is its considerably lower cost.

Another advantage is its minimal installation time and thus minimal disruption at an installation site.

Further objects and advantages of the invention will be apparent from studying the following portion of the specification, the claims and the attached drawings.

DESCRIPTION OF THE PREFERRED AND ALTERNATE EMBODIMENTS

Figure 1:
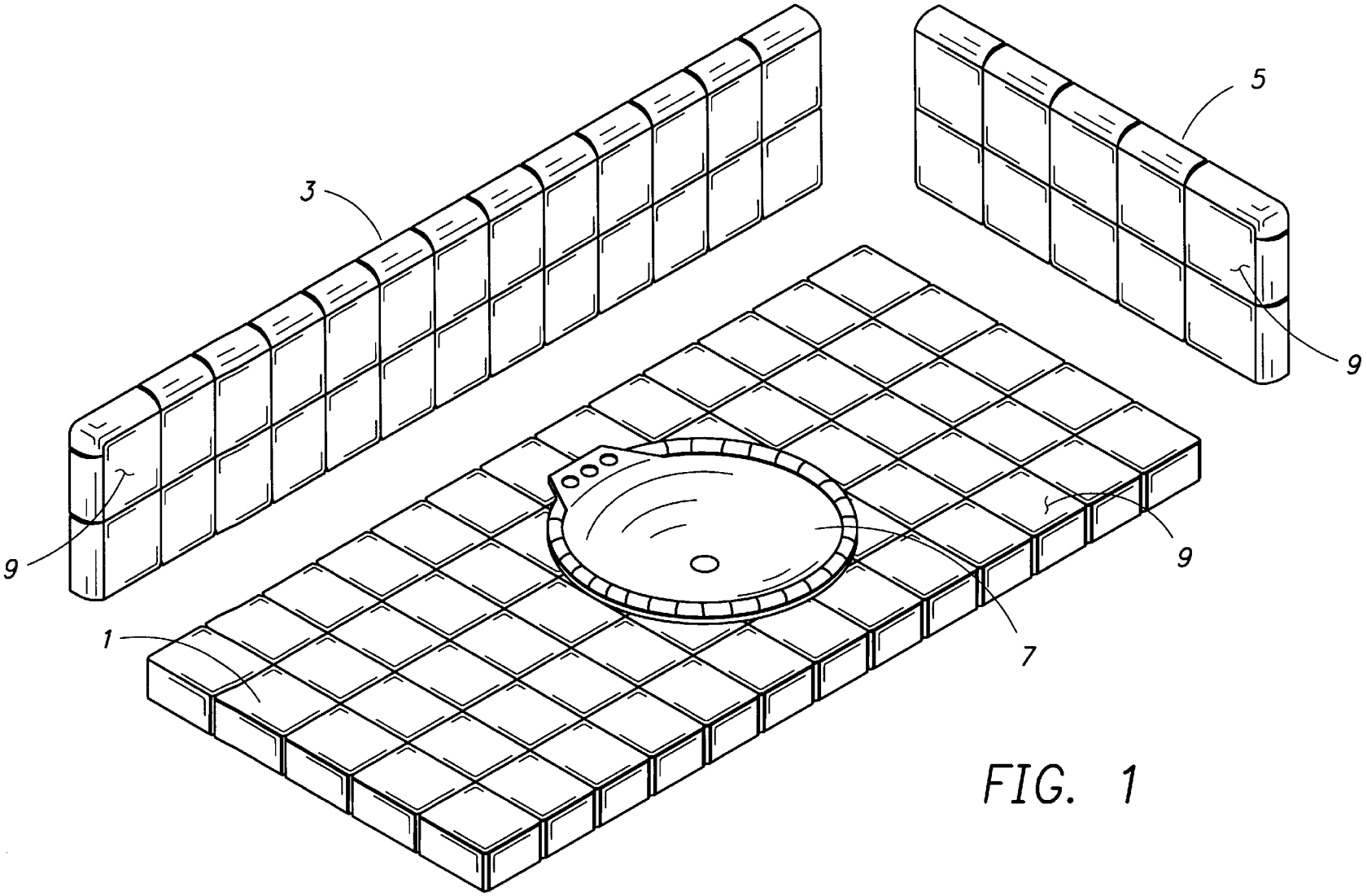
FIG. 1 is a perspective of a typical counter top and splash panels according to the present invention.

Referring particularly to the drawings, there is shown in FIG. 1 a perspective view of a typical complete tiled counter top 1, tiled back splash panel 3 and tiled side splash panel 5 according to the present invention, ready for installation at a site. A single inset sink 7 is shown included in the counter top 1. However, there may be more than one sink 7 included or none at all, leaving a blank top depending on the customer's requirements. A sink may also be inset as depicted in FIG. 1 or top set if so desired. Similarly, the tiles 9 may be of any type, material, size and color, arranged in a pleasing design.

In practice, a number of different design counter tops would be produced, allowing a customer to view and select a counter top prior to installation. Counter tops may also be specially designed and fabricated to a customer's specification. This is particularly advantageous in cost and time for builders of design homes and other buildings requiring a few fixed counter designs in quantity.

In the following drawing figures to be discussed, some include features that are exaggerated in relative size. This has been done to ensure ease of understanding the invention construction as drawn, and should not be construed as being relative dimensions.

Figure 2:
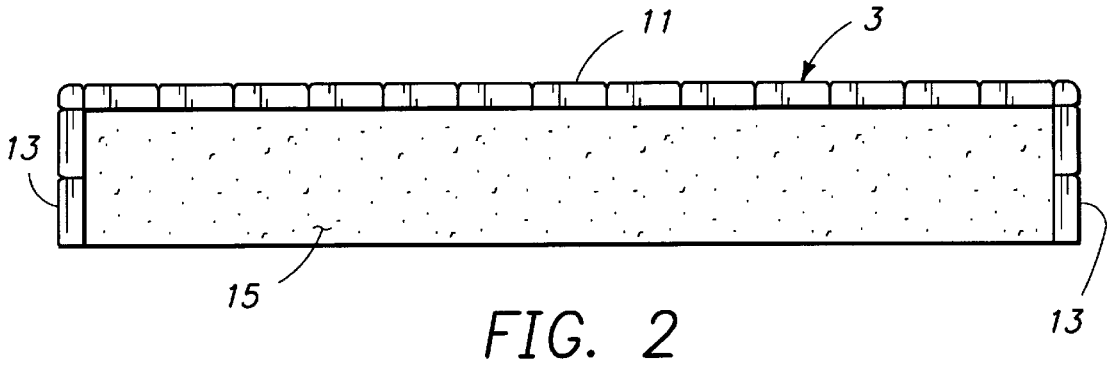
FIG. 2 is a back elevation view of a splash panel according to the present invention.
Figure 3:
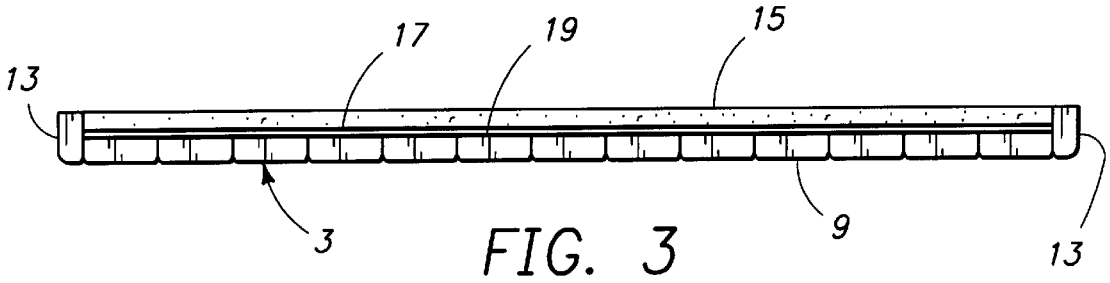
FIG. 3 is a bottom end view thereof, particularly showing the layers and components comprising a splash panel.

Refer now to FIGS. 2 and 3 which are respectively, a back view of a back splash panel 3 and a bottom end view of the panel. A side splash panel 5 is constructed identically to a back splash panel 3. Both splash panels are fabricated using a rigid back board 15 on which a layer of adhesive 17 such as thinset or mastic is spread and the front tiles 9, top edge trim tiles 11 and side edge trim tiles 13 are grouted and adhered to the back board 15. A splash panel would be installed after the counter top 1 was installed, in a manner in which the tile grout joints in the splash panel would line up with the counter top 1 if so desired. This is accomplished by applying a silicone or other caulking material to the back of the splash panel and pressing it to the wall while shimming the splash panel so as to provide a dimensional acceptable joint space between the counter top and the splash panel. In the event that there are adjacent back or side splash panels, there would be the same joint spacing between them as well, usually equal in size to a typical grout joint, in the counter top 1. These joints would finally be caulked not grouted, in accordance with Tile Council of America standards after the panels have dried in place and the shims have been removed.

The splash panel back board 15 which serves as a base for the tiles, may be a cement board, greenboard, sheetrock, styrofoam, wood sheet, "Dens-Shield", or EIFS which is marketed under the trade name "DRYVIT". If a wood back board is used as the base, it will be necessary to add a waterproof membrane over the wood before adhering the tiles.

Any kind of tiles may be used to provide the splash board tiled surface. These include ceramic tiles, stone tiles, thin-brick tiles, quarry tiles, mosaic tiles, concrete tiles and simulated stone tiles, etc.. These tiles may also be used for tiling the counter top surfaces.

Figure 4:
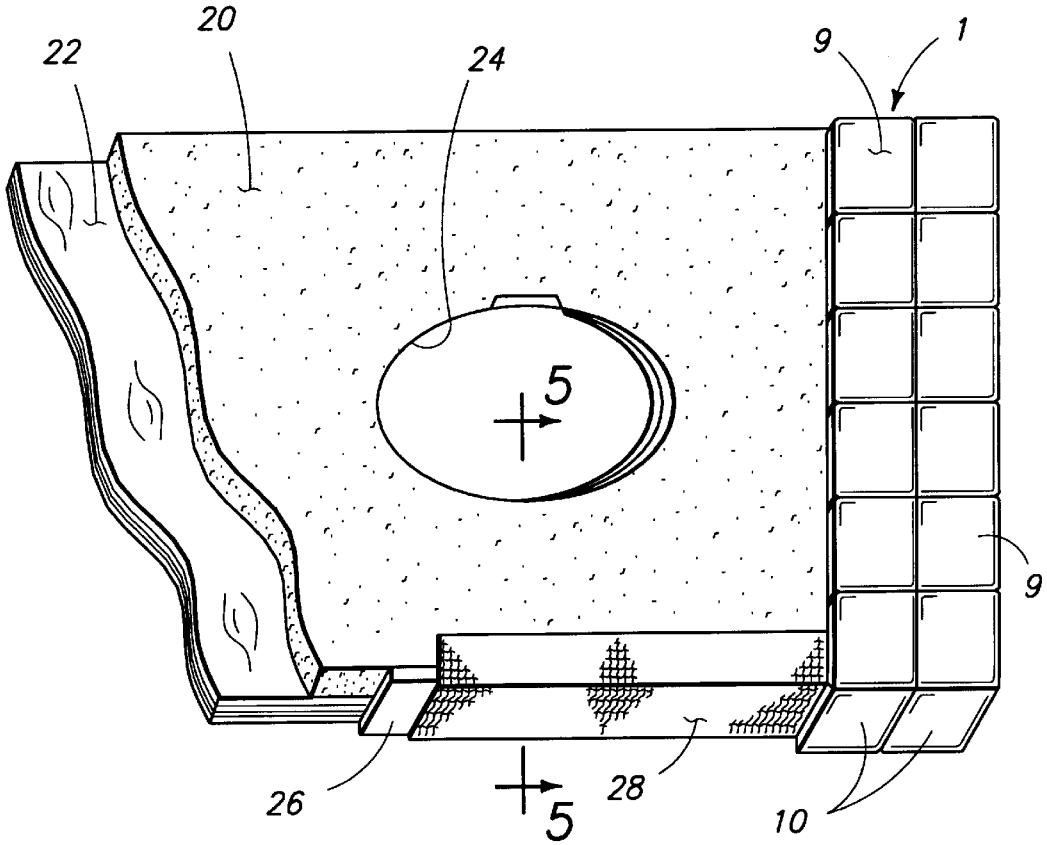
FIG. 4 is a top, partial view of a counter top substrate according to the present invention, particularly showing some tiles installed and how the substrate open edges are covered prior to fastening tiles in place.

Referring now to FIG. 4, there is shown a partial top view of the substrate of a preferred embodiment counter top 1, with portions cut away showing the major components that form the substrate. These components are: a rigid top surface board 20, a rigid base board 22 which is bonded to the top surface board 20, three edge strip boards, one of which is located covering the front edge 26 and two side strips, and self adhesive drywall crack tape 28.

The counter top 1 is produced using the following steps:

1. A sheet of plywood or other rigid subpanel material is selected for the base board 22 and cut to the desired dimensions and shape to fit on a cabinet. A hole 24 for a sink is cut if a sink is required.
2. A surface board 20 is selected and cut to fit exactly over the base board 22. The surface board material may be cement board, greenboard, styrofoam, EIFS, "Dens-Shield", rigid sheet plastic, drywall or sheetrock.
3. Mastic or thinset mortar is spread over the base board 22 and the surface board 20 is laminated to it by clamping and pressing the two together, forming a single rigid base.
4. Edge strip boards 26, which are small strips of surface board, are attached with mastic or thinset mortars covering all the base edges where the base board 22 and surface board 20 are joined and that would be exposed for tiling.
5. Self adhesive drywall crack tape 28, which is a fine fiberglass mesh strip treated with adhesive, is applied to all exposed substrate joints.
6. Finally, the tiles 9, 10, are set and grouted in place. If an inset sink 7 such as shown in FIG. 1 is to be installed, the sink cutout 24 on the surface board 20 will be larger than the cutout on the base board 22, allowing the sink to fit in and drop onto a ledge, placing it ½ in. to ¾ in. below the top surface of the tiles 9. Appropriate tile trim units can then be grouted in place to cover the exposed sink rim and to complete the counter top.

A top set sink may be installed in the counter top either at the time of tiling or at a later time.

Figure 5A:
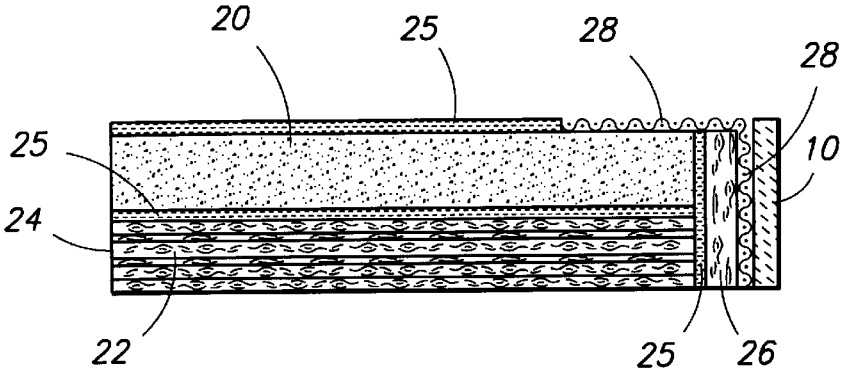
FIG. 5A is a cross-section view of a preferred embodiment counter along 5—5 of FIG. 4, showing the component parts and layers comprising a substrate.

FIG. 5A is a cross-section view of the preferred embodiment counter top 1, taken along line 5—5 of FIG. 4. It clearly shows the result of the counter top production steps briefly described above, excepting the installation of the top tiles. The mastic or thinset adhesive layers 25 are shown in place as is the crack tape 28. The substrate assembly so described, is rigid and strong enough to support the weight of the tiles and any normally expected weight to be placed on the counter without bending or cracking. As with all tiled counter tops that are presently fabricated and installed at a customer's site, a complete pre-fabricated counter top 1 must be properly supported by the cabinet on which it is installed.

Figure 5B:
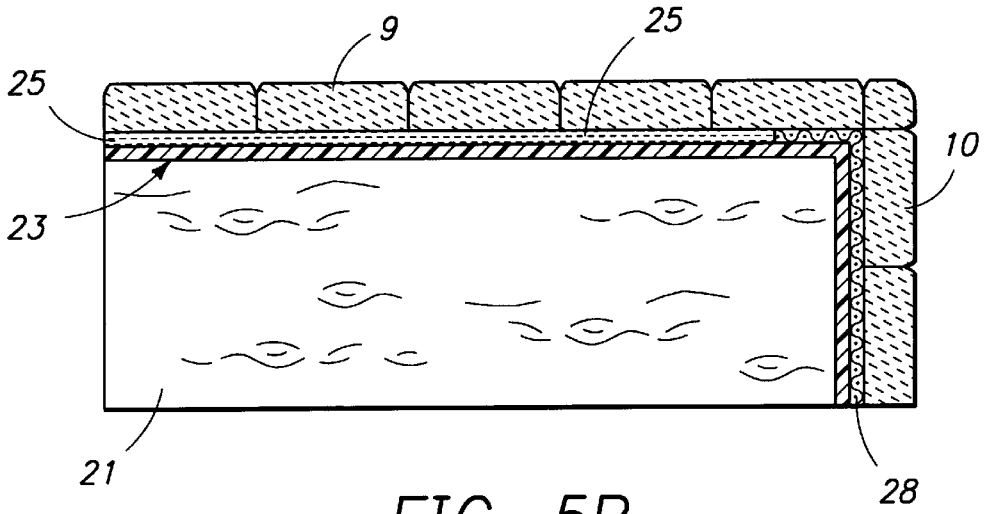
FIG. 5B is a cross-section view of an alternate embodiment counter, fully assembled with tiles installed.

Refer now to FIG. 5B. This is a cross-section of an alternate embodiment counter top 1. Starting from the bottom, the components comprise a rigid wood sheet base board 21, a waterproof membrane sheet 23 covering the top and sides of the base board 21, self-adhesive drywall crack tape 28, mastic or thinset mortar 25 which is spread over the substrate top surface and crack tape, and tiles 9 set and grouted. on the top surface and on the sides 10.

A waterproof membrane 23 is required to protect the wood base board from any spilled liquid that may enter through cracks in the tiles. The base board 21 may be a plywood sheet or any other rigid wood panel, so long as it has the requisite dimensions and strength.

Figure 5C:
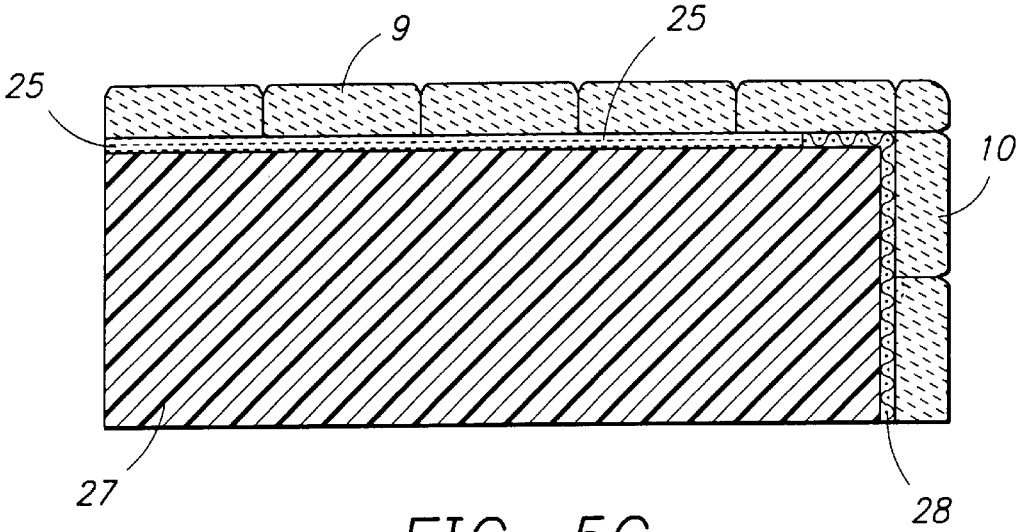
FIG. 5C is a cross-section view of another alternate embodiment counter, particularly showing a plastic substrate and fully assembled with tiles installed.
Figure 5D:
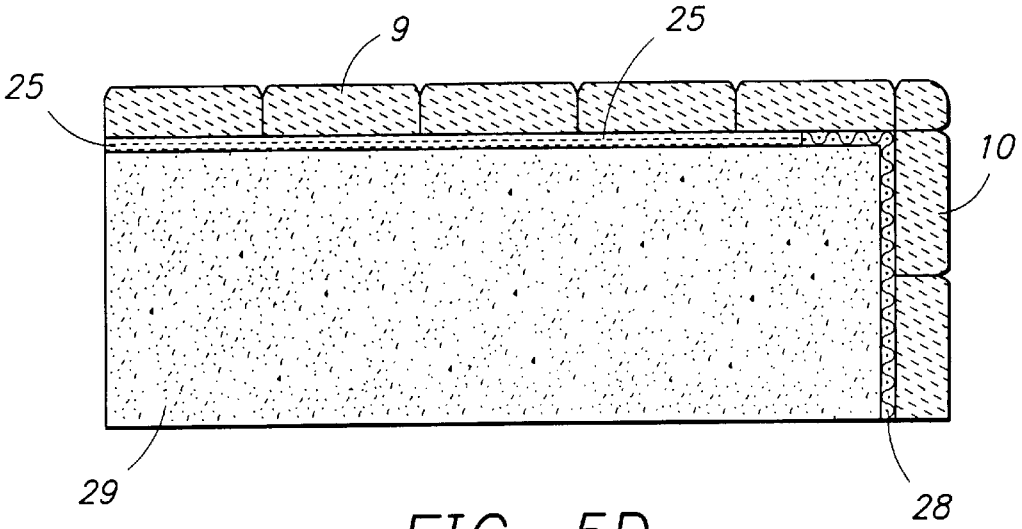
FIG. 5D is a cross-section view of another alternate embodiment counter, particularly showing a styrofoam substrate and fully assembled with tiles installed.

Other alternate embodiment counter tops 1 would be the use of a single, solid piece of styrofoam 29 as shown in FIG. 5D or plastic 27 as shown in FIG. 5C, that is tiled and grouted, and ready to install on a cabinet.

Figure 6:
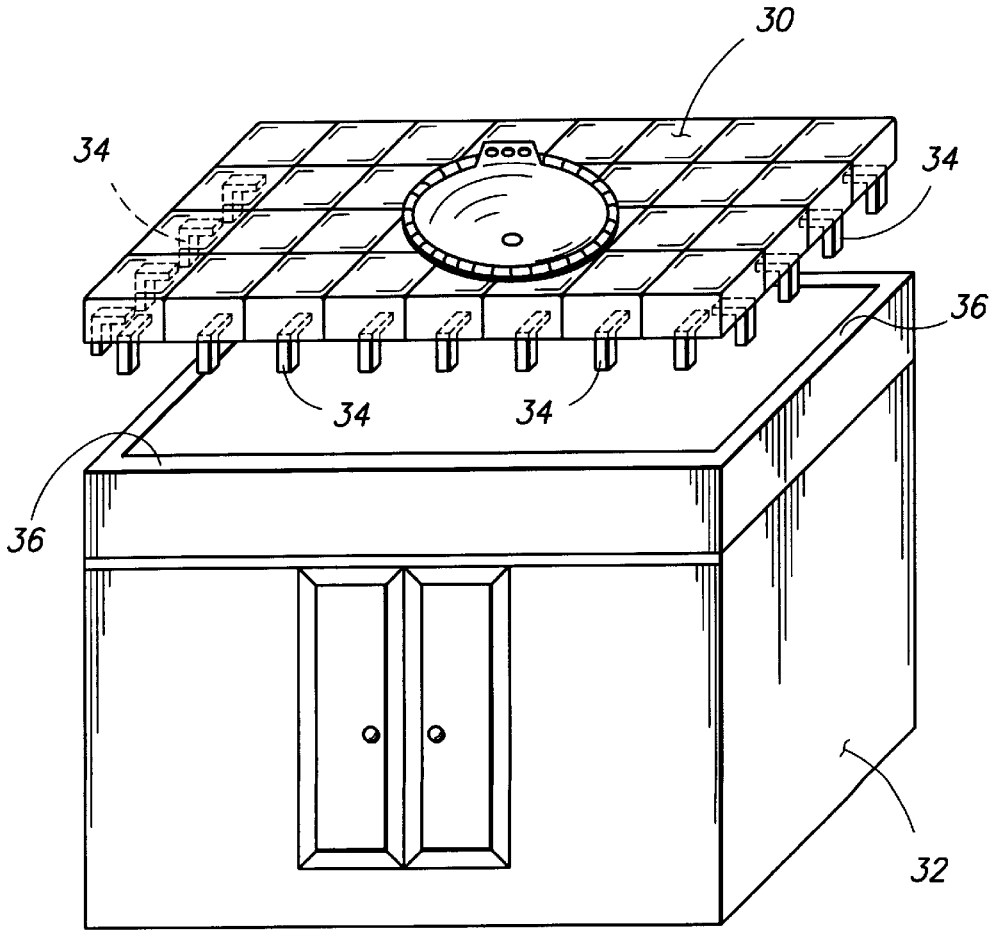
FIG. 6 is a perspective view of a complete counter top in position for installing on a cabinet, particularly showing L-shaped brackets attached to the counter bottom.

For installing a pre-fabricated complete counter top 1 such as shown in FIG. 1 on a cabinet in a kitchen or bathroom, the counter top would usually be placed on the cabinet and adhered from below with adhesives and caulking material. However, when used for bathroom vanity tops, which is an ideal application, the counter top would need some means of preventing it being shifted laterally off a vanity cabinet. Such a means is illustrated in FIG. 6.

A vanity cabinet 32 is usually constructed having top edges defining a rim 36 around the cabinet top to support a counter top. For this application, the pre-fabricated counter top 30 would include a number of L-shaped brackets 34 that are fixed to the bottom surface of the counter 30, located spaced apart around the counter perimeter. For installation, caulking is placed on the upper edges 36 of the cabinet and the counter top is simply laid upon the cabinet and adhered to it. The brackets will effectively prevent any lateral shifting of the counter top with respect to the cabinet. In addition, if a topset sink is used, its attachment would also help secure the counter top in place.

Finally, there are some applications where the required counter tops and/or splash panels are very long. For these applications, it would be necessary to split the counter top and/or splash panels into two or more completed sections.

Figure 7:
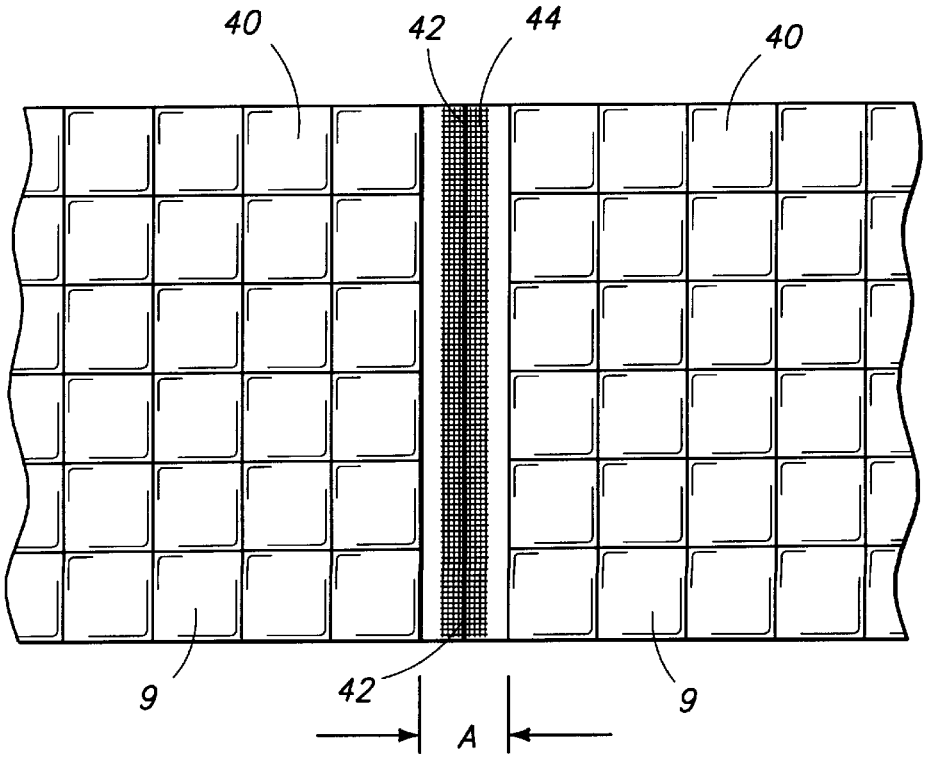
FIG. 7 is a partial plan view of two counter sections attached at their joining edge by a taped adhesive.

FIG. 7 illustrates the recommended method of joining these completed sections when they are installed. The counter top or splash panel sections 40 are tiled 9 leaving an untiled space at the section edge 42 which is to be joined. When the sections are installed on a cabinet or wall surface and placed edge 42 to edge as shown in FIG. 7, it will leave a space "A" one tile wide between the tiled areas. The edges 42 are covered with a strip of self-adhesive drywall crack tape 44 and filled and coated with a fast-setting joint compound. After allowing time for the joint to dry, tiles are grouted in place to cover the untiled edge area, and installation of the sections is finished.

The invention counter top and splash panels would be ideal for do-it-yourselfer's as it would be relatively simple to install. The product would eliminate the present need to locate tile-setters, get quotations, have a tile-setter come to the home and hope the workmanship was up to standard. With this product easily available, the workmanship would be known at, the time of purchase by the homeowner, and the counter top and splash panels could be installed by a cabinet installer, a plumber or a homeowner. There should also be a cost benefit to the homeowner as well as a minimum of mess to be cleaned up and a minimum of inconvenience and time delays. For example, a small counter could be installed in about an hour.

Builders will also benefit from this as they could greatly reduce the need for skilled tile-setters and the time consuming and messy operation that this type of work normally involves. It would also reduce the occurrence of unsatisfactory workmanship as the builder too would be able to view the complete counter and splash panels before they were installed at a site.

The cost of the completed product would be substantially less to a builder than the present day methods of installing tiled counter, and the impact to a construction schedule would be significantly improved.

From the above description, it is clear that the preferred and alternate embodiments achieve the objects of the present invention. Alternative embodiments and various modifications may be apparent to those skilled in the art. These alternatives and modifications are considered to be within the spirit and scope of the present invention.

Having described the invention, what is claimed is:

1. A complete pre-fabricated tile counter comprising:

(a) a tiled counter top adapted as a single unit, said counter top comprising a flat substrate body and a tile material affixed to a top surface and edges of said substrate body; said substrate body comprising:

a flat base board member made of plywood, a cementitious surface board member, said base board member having a mastic or thinset mortar spread over its top surface and said surface board member laminated to said top surface by applied pressure, forming a single rigid flat base;

a plurality of edge strip boards, said edge strip boards sized in width to match the thickness of said base, said edge strip boards being adhered with mastic or thinset mortar to the side edges of said base, covering all base board and surface board joint edges that would be exposed for tiling; and a self-adhesive drywall crack tape, said tape being adhered to the top surface and side edges of said base, covering any exposed substrate joints;

(b) means for preventing lateral shifting of said counter top after installation on a cabinet;

(c) a plurality of tiled splash-panels adapted as units, sized and matched to be installed with said counter top at a user site, each of said splash panels comprising a cementitious back board member having a planar front surface and a back surface parallel with said front surface, and tile material affixed to said front surface, and to side edges of said back board member;

said counter top being ready for mounting and attachment to a cabinet top with adhesives and caulking material, said splash panels being ready for mounting on walls next to said counter top, using adhesives and caulking material applied to the back surface of said panels.

2. The tile counter as defined in claim 1 wherein said counter top includes a plurality of sinks that are inset or topset in the tiled top surface of said counter top, said sinks being adhered with mastic or thinset mortar to the edges of sink cutouts in said substrate body, caulked in place and finished with trim tiles that cover the exposed sink rims, said sinks being ready for connection to plumbing when said tile counter is installed at a site.

3. The tile counter as defined in claim 1, wherein said means to prevent lateral shifting of said counter top after installation on a cabinet, includes a multiplicity of "L"-shaped metal brackets that are fastened to the bottom surface of said substrate body and located around the substrate surface perimeter, said brackets adapted to impinge on the walls of the cabinet and preventing lateral movement of said counter top.

4. The tile counter as defined in claim 1, wherein said surface board member material is greenboard.

5. The tile counter as defined in claim 1, wherein said surface board member material is a coated polystyrene.

6. The tile counter as defined in claim 1, wherein said surface board member is made of an acrylic coated tile-backer material.

7. The tile counter as defined in claim 1, wherein said surface board member material is rigid sheet plastic.

8. The tile counter as defined in claim 1, wherein said surface board member material is drywall sheet.

9. The tile counter as defined in claim 1, wherein said surface board member material is sheetrock.

10. The tile counter as defined in claim 1, wherein the material of said back board member in said splash panels is greenboard.

11. The tile counter as defined in claim 1, wherein the material of said back board member in said splash panels is a coated polystyrene.

12. The tile counter as defined in claim 1, wherein the material of said back board member in said splash panels is sheetrock.

13. The tile counter as defined in claim 1, wherein the material of said back board member in said splash panels is foamed polystyrene.

14. The tile counter as defined in claim 1, wherein the material of said back board member in said splash panels is a wood sheet including a waterproof membrane adhered to the sheet front face and edges, to which said tiles are to be affixed.

15. The tile counter as defined in claim 1, wherein the material of said back board member in said splash panels is an acrylic coated tile-backer material.

16. The tile counter as defined in claim 1, wherein the tile material comprises ceramic tile, stone tile, thinbrick tile, quarry tile, concrete tile, or simulated stone tile.

17. A method of joining completed sections of counter tops or splash panels that are fabricated according to claim 1, in order to make very long counter tops or panels, the method comprising the steps of:

(a) leaving an untiled space one half a tile wide at each of the section edges to be joined;

(b) placing the edges of two sections to be joined together so that there is a single tile width untiled space strip between the sections, and covering the joint edge area with a strip of self-adhesive drywall crack tape;

(c) filling and coating the crack tape with a fast setting joint compound;

(d) drying the joined area in air; and (e) grouting and setting tiles in place to cover the untiled space strip over the joined section edges.

* * * * *